US007141184B2

(12) United States Patent
Chacko

(10) Patent No.: US 7,141,184 B2
(45) Date of Patent: Nov. 28, 2006

(54) POLYMER CONDUCTIVE COMPOSITION CONTAINING ZIRCONIA FOR FILMS AND COATINGS WITH HIGH WEAR RESISTANCE

(75) Inventor: Antony P. Chacko, Granger, IN (US)

(73) Assignee: CTS Corporation, Elkhart, IN (US)

( * ) Notice: Subject to any disclaimer, the term of this patent is extended or adjusted under 35 U.S.C. 154(b) by 332 days.

(21) Appl. No.: 10/730,623

(22) Filed: Dec. 8, 2003

(65) Prior Publication Data

US 2005/0121653 A1 Jun. 9, 2005

(51) Int. Cl.

| | |
|---|---|
| ***H01B 1/06*** | (2006.01) |
| ***H01B 1/02*** | (2006.01) |
| ***H01B 1/22*** | (2006.01) |
| ***B05D 5/12*** | (2006.01) |

(52) U.S. Cl. ..... 252/507; 252/511; 252/512; 252/514; 427/96.1

(58) Field of Classification Search ..... 252/511, 252/512, 513, 514

See application file for complete search history.

(56) References Cited

U.S. PATENT DOCUMENTS

| | | | | |
|---|---|---|---|---|
| 3,870,987 | A | 3/1975 | Wiley et al. | |
| 4,313,101 | A | 1/1982 | Bloore et al. | |
| 4,621,249 | A | 11/1986 | Uchikawa et al. | |
| 4,722,853 | A * | 2/1988 | Batliwalla et al. | 427/256 |
| 5,035,836 | A | 7/1991 | Gardos et al. | |
| 5,071,593 | A * | 12/1991 | Takahashi et al. | 252/500 |
| 5,111,178 | A * | 5/1992 | Bosze | 338/160 |
| 5,318,823 | A | 6/1994 | Utsumi et al. | |
| 5,430,087 | A | 7/1995 | Carlson et al. | |
| 5,470,643 | A * | 11/1995 | Dorfman | 428/206 |
| 5,677,367 | A | 10/1997 | Savin | |
| 5,781,100 | A | 7/1998 | Komatsu | |
| 5,883,173 | A | 3/1999 | Elspass | |
| 5,955,936 | A | 9/1999 | Shaw et al. | |
| 6,060,549 | A | 5/2000 | Li | |
| 6,172,595 | B1 | 1/2001 | Komatsu | |
| 6,180,275 | B1 | 1/2001 | Zabriskie | |
| 6,184,280 | B1 | 2/2001 | Shibuta | |
| 6,359,544 | B1 * | 3/2002 | Blok | 338/22 R |
| 6,380,294 | B1 | 4/2002 | Bibinec et al. | |
| 6,512,039 | B1 | 1/2003 | Mowrey | |
| 6,533,955 | B1 * | 3/2003 | Molnar et al. | 252/511 |
| 6,617,377 | B1 | 9/2003 | Chacko | |

FOREIGN PATENT DOCUMENTS

| | | |
|---|---|---|
| EP | 0 391 534 A | 10/1990 |
| WO | WO 01 36536 A | 5/2001 |

* cited by examiner

*Primary Examiner*—Mark Kopec
*Assistant Examiner*—Jaison Thomas
(74) *Attorney, Agent, or Firm*—Mark P. Bourgeois

(57) ABSTRACT

A resistive composition for screen printing onto a substrate to form a cured film. The resistive composition, based on total composition, has a) 5–30 wt. % of polymer resin, b) 10–30 wt. % conductive particles selected from the group consisting of carbon black, graphite and mixtures thereof and c) 0.1–10 wt. % zirconia particles, wherein all of (a), (b), and (c) are dispersed in a 60–80 wt. % organic solvent. A cured resistive film composition is also disclosed.

34 Claims, 5 Drawing Sheets

POLYMER CONDUCTIVE COMPOSITION CONTAINING ZIRCONIA FOR FILMS AND COATINGS WITH HIGH WEAR RESISTANCE

BACKGROUND

This invention generally relates to polymer thick film conductive compositions and coatings. In particular, the invention is directed to such compositions, which are suitable for making variable resistive elements such as those used in position sensors.

Electrically resistive or conductive polymer thick film compositions have numerous applications. Polymer thick film (PTF) resistive compositions are screenable pastes, which are used to form resistive elements in electronic applications. Such compositions contain conductive filler material dispersed in polymeric resins, which remain an integral part of the final composition after processing.

Resistive compositions are used as resistive elements in variable resistors, potentiometers, and position sensor applications. A resistive element is, in most cases, printed over a conductive element, which acts as a collector element. In position sensing applications, a metallic wiper slides over the resistive element. The wiper can slide back and forth for several million cycles over the collector and resistive elements during the lifetime of the electronic component. For accurate position sensing, the wiper should give continuous electrical output throughout the life of the sensor.

The durability of these position sensing elements depends on the mechanical properties of both the resistor and the conductive film. The polymer thick films tend to wear out after several million cycles of sliding with a metallic contactor over the element at extreme temperature conditions typically seen in an environment such as an automotive engine compartment. Therefore, polymer resistive and conductive compositions having excellent mechanical properties and wear resistance are required for performance and signal output in these applications.

In addition to good mechanical properties, these materials should also have good thermal properties. Polymer thick films show a decrease in storage modulus as temperature is increased. A sharp decrease in mechanical properties is observed near the glass transition temperature. In addition to loss in modulus, these materials also tend to show an increase in coefficient of thermal expansion, which increases significantly above the glass transition temperature (Tg). When used in, for example, motor vehicles, a position sensor is exposed to high temperatures in under the hood applications.

At these temperatures, resistive elements show a high rate of wear due to a decrease in modulus properties. In addition to the surrounding temperature, a still higher temperature is observed at the interface between the metallic wiper and the resistive element surface due to frictional heating. In some cases, these temperatures can approach the glass transition temperature (Tg) of the resistive material and can cause loss of the material's mechanical properties, which adversely affect signal output.

A prior art resistor composition is as follows:

Prior Art Composition

| Component | Weight (%) |
|---|---|
| Polyamide imide | 21.58 |
| Carbon black | 5.47 |
| N-methyl pyrrolidone | 72.95 |

One way to improve mechanical properties of a resistive film is to incorporate fillers, such as short fibers, in these films. The presence of fibers of relatively large dimension creates an electrically heterogeneous surface. This results in non-linear electrical output in contact sensor applications. Even when the size of the fibers is in the order of a few microns, the surface is still electrically and mechanically heterogeneous. A dither motion at high frequency on a surface region where these fibers are absent can create large wear.

Another problem with using fibers with greater than 10 volume percentage is they can significantly wear the metallic contactor. This wear is accelerated if these fibers are protruding from the surface. Therefore, there is a need in the art for a conductive wear resistant coating or resistor composition and cured film with enhanced mechanical and thermal properties that exhibits homogeneous surface electrical characteristics and good signal quality.

SUMMARY OF THE INVENTION

A resistive composition for screen printing onto a substrate is provided. The resistive composition, based on total composition, has a) 5–30 wt. % of polymer resin, b) 10–30 wt. % conductive particles selected from the group consisting of carbon black, graphite and mixtures thereof and c) 0.1–10 wt. % zirconia particles, wherein all of (a), (b), and (c) are dispersed in a 60–80 wt. % organic solvent.

The present invention provides an improved resistive composition with zirconia particles that has increased mechanical, wear, electrical, and thermal properties.

The present invention further provides an applied film that has 40–75 percent by weight of a cured polymer resin, 10–35 percent by weight of conductive particles selected from the group consisting of carbon black, graphite and mixtures thereof and 0.01–10 wt. percent by weight of zirconia particles.

DETAILED DESCRIPTION

Figure 1:
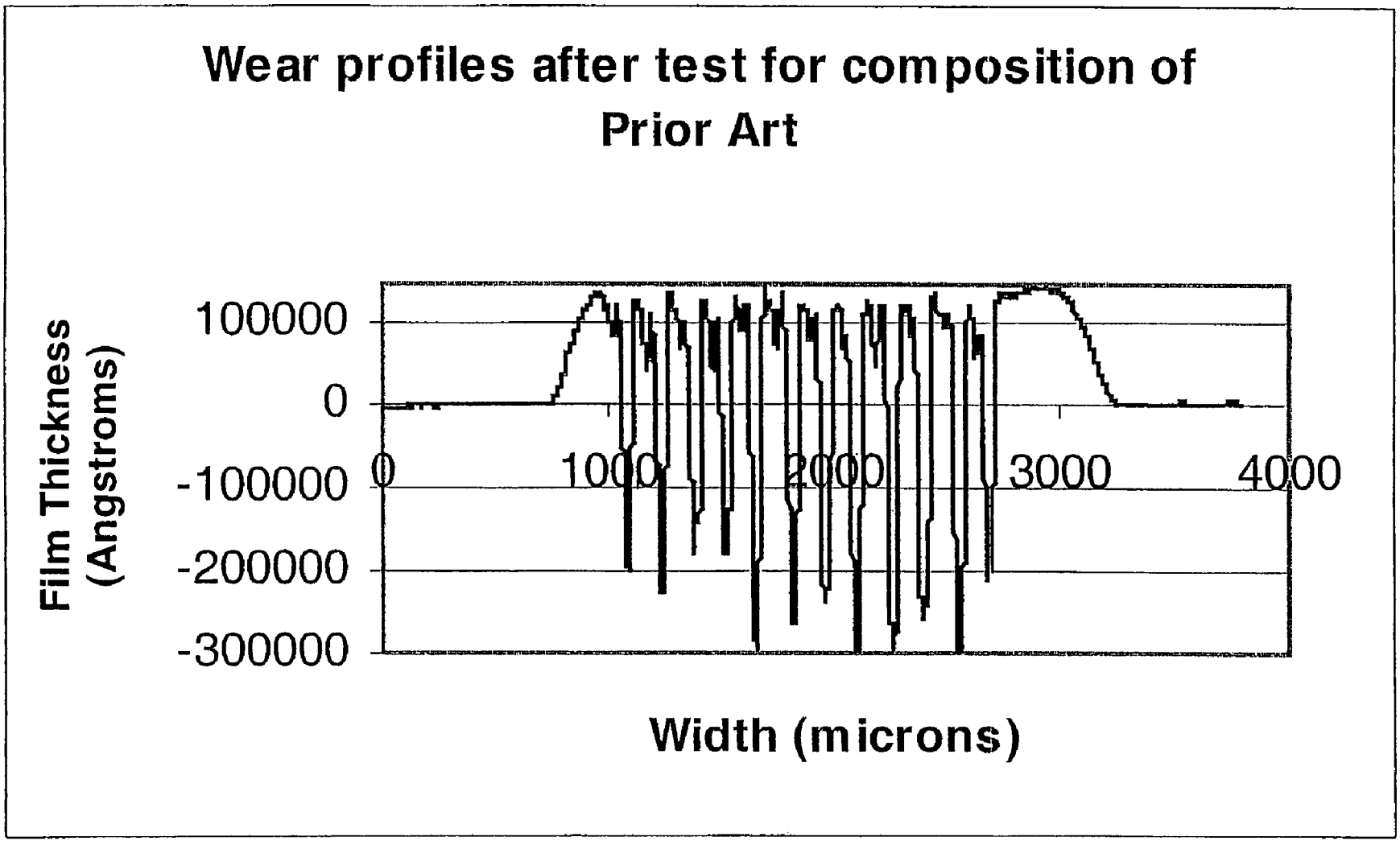
FIG. 1 shows the surface profile or wear for a prior art resistor composition after durability testing.

According to a preferred embodiment of the invention, a resistive composition for screen printing onto a substrate will now be described. In particular, the composition includes polymer components, zirconia particles, nanomaterials components, electrically conductive components and other additives. The composition is carried by an organic vehicle. The details of all these components, its method of preparation, and associated printing procedures are discussed below.

Polymer Components

Polymers with functional groups capable of forming secondary bonding with zirconia particles and nano particles are preferred for these compositions. In addition to the functional groups, the polymers should also have a high glass transition temperature. It is critical for some high temperature applications, such as automotive applications, that these materials maintain a high storage modulus during the use and lifetime of the materials. The polymer component used in the present invention comprise 5–30 wt. % of a high Tg polymer selected from polyimides, polyamide imides, polysulfones, polyphenylenes, polyether sulfones, polyarylene ethers, polyphenylene sulfides, polyarylene ether ketones, phenoxy resins, polyether imides, polyquinoxalines, polyquinolines, polybenzimidazoles, polybenzoxazoles, polybenzothiazoles, phenolic, epoxy,diallyll isophthalate copolymers thereof, and mixtures thereof, based upon total composition.

In addition to this polymer, 0–10% of another thermosetting polymer can be used. The choice of the second polymer depends on the application, as will be discussed more fully below. The second polymer can be selected from aromatic cyanate ester, epoxy, phenolic, diallyl isophthalate, bismaleimide, polyimide, etc. The polymers are dissolved in an organic solvent. The percentage compositions are based upon total composition.

In the composition of the present invention, the polymer is used in the range of 5–30 wt. % by weight of the conductive composition, with a more preferred range of 15–20 wt. %. If less than 5 wt. % polymer is used, the resulting conductive composition has been found to have poor screen printing properties, as well as weak mechanical properties and poor adhesion. If more than 30 wt. % polymer is used, the resulting composition has a lower than desirable electrical conductive property.

An optional second polymer is sometimes added to increase the interfacial bonding between nanomaterials and the matrix resin. The second polymer is preferably a high temperature thermosetting polymer and is used in the range of 0–10 wt. %. The amount of this resin in the composition is determined by the application requirements. Increasing the amount of the second thermosetting polymer decreases flexibility, but improves temperature performance at high temperature. Depending on the amount of the second polymer, the cured film can either behave as a molecular composite, a semi-interpenetrating network, or an immiscible blend. This versatility in morphology can be judiciously chosen for a given application.

Wear Enhancing Components

The wear and thermal properties of these wear resistant resistive films can be increased by incorporating zirconia particles and other materials of nanodimensions into the resistive compositions. The particle size of the zirconia particles used in this invention varies from 100 nanometers to 10 microns. The zirconia particles are used in the range of 0.025–10 wt % of the total composition.

Nanoparticles and nanofibers can be used in the composition of the present invention. The nanoparticles and fibers can be selected from carbon nanotubes, vapor grown carbon nanofibers, milled carbon fibers, molecular silica, nanoclay, and the like. Nanoparticles and nanofibers may be pretreated or preprocessed to obtain better dispersion of these materials. The nanoparticles are used in the range of 0.025–20 wt % of the composition. A preferred range is 0.1–7 wt %.

Electrically Conductive Components

The electrically conductive component of the present invention comprises finely divided particles of electrically conductive materials such as carbon black, graphite, silver, copper, nickel or mixtures thereof. This includes mixtures of the metallic and carbon powders. The preferred particles are carbon black. The preferred conductive particles comprise 1–25 wt. % of the conductive composition, with a most preferred range of 1–10 wt. %. The preferred carbon black is commercially available from Degusaa Corporation.

Other Additives

Antifriction additives such as fluoropolymers (PTFE) and graphite are preferably used to decrease the friction between the resistive film surface and the sliding contact. The antifriction additives comprise 1–20 wt. % of the resistive composition, with a preferred range of 5–10 wt. %. The preferred fluropolymer (PTFE) is commercially available from Dupont.

Wetting agents such as fluorinated oligomers may be added to the composition for wettability and leveling properties. Up to 1 wt. % of a fluorinated surfactant may be used. The fluorinated oligomers are commercially available from 3M Corporation.

Organic Vehicle

An organic solvent of 20–40 wt. % is used to dissolve the resistive composition. The preferred solvent used is N-methyl pyrrolidone. The selection of the solvent is based on the good solubility of the polymer in this solvent. This solvent also has a high boiling point. Low evaporation of the solvent is preferred for continuous printing operation where no change in viscosity of the composition due to loss of solvent is desired. The polymer is dissolved completely in the organic vehicle prior to blending with the other components. N-methyl pyrrolidone is commercially available from BASF Corporation.

General Composition Preparation and Printing Procedures

In the preparation of an exemplary composition of the present invention, a polymer solution is made by mixing 10–20 wt. % of a polymer and 0–10 wt. % thermosetting resin in 60–80 wt. % N-methyl pyrrolidone based upon total composition. The polymer is mixed with both the conductive particles, zirconia particles, antifriction additives and nanoparticles to form a paste with fine particle size. At this point, surfactants and Theological additives may be added if desired to modify the properties of the resistive composition. The paste is mixed in a ball mill for several hours. Other methods of mixing could be used, such as employing high-speed shear to thoroughly blend the particles in the polymer binder. However, ball milling is preferred for preparing resistive composition with uniform particle size. The particle size range and viscosity of the paste is monitored to obtain a resistive paste suitable for application in position sensors. The milling time and milling quantity on the ball mill determines the final particle distribution, size and resulting rheology.

The resistive paste thus prepared is applied to substrates such as polyimide, ceramic and fiber reinforced phenolic substrates by conventional screen printing processes. A preferred substrate is polyimide. The wet film thickness typically used for position sensor application is 40 microns. The wet film thickness is determined by the screen mesh and screen emulsion thickness. A preferred screen mesh of 250 is used for obtaining smooth resistive film on a polyimide substrate for position sensors. The paste is then air dried and cured in an oven between 200 and 350 degrees Centigrade for 1 to 10 hours. The result is a cured resistive film on the substrate.

EXAMPLES

The present invention will be described in further detail by giving practical examples. The scope of the present invention, however, is not limited in any way by these practical examples.

All component concentrations are expressed as percentage by weight.

Example 1

| Component | Weight (%) |
|---|---|
| Polyamide imide | 21.43 |
| Carbon black | 5.43 |
| Zirconia particles | 0.68 |
| N-methyl pyrrolidone | 72.45 |

Example 2

| Component | Weight (%) |
|---|---|
| Polyamide imide | 21.29 |
| Carbon black | 5.40 |
| Zirconia particles | 0.67 |
| Nanoclay | 0.67 |
| N-methyl pyrrolidone | 71.96 |

Example 3

| Component | Weight (%) |
|---|---|
| Polyamide imide | 21.15 |
| Carbon black | 5.36 |
| Zirconia particles | 0.67 |
| Nanoclay | 0.67 |
| Milled Carbon fiber | 0.67 |
| N-methyl pyrrolidone | 71.48 |

Example 4

| Component | Weight (%) |
|---|---|
| Polyamide imide | 21.29 |
| Carbon black | 5.40 |
| Zirconia particles | 0.67 |
| Vapor grown carbon fibers | 0.67 |
| N-methyl pyrrolidone | 71.96 |

Example 5

| Component | Weight (%) |
|---|---|
| Polyamide imide | 21.15 |
| Carbon black | 5.36 |
| Zirconia particles | 0.67 |
| Vapor grown carbon fibers | 0.67 |
| Milled Carbon fiber | 0.67 |
| N-methyl pyrrolidone | 71.48 |

Example 6

| Component | Weight (%) |
|---|---|
| Polyamide imide | 21.15 |
| Carbon black | 5.36 |
| Zirconia particles | 0.67 |
| Nanoclay | 0.67 |
| Vapor grown carbon fibers | 0.67 |
| N-methyl pyrrolidone | 71.48 |

Example 7

| Component | Weight (%) |
|---|---|
| Polyamide imide | 21.15 |
| Carbon black | 5.36 |
| Zirconia particles | 0.67 |
| Carbon nanotubes | 0.67 |
| Milled Carbon fiber | 0.67 |
| N-methyl pyrrolidone | 71.48 |

Example 8

| Component | Weight (%) |
|---|---|
| Polyamide imide | 21.29 |
| Carbon black | 5.40 |
| Zirconia particles | 0.67 |
| Milled Carbon Fiber | 0.67 |
| N-methyl pyrrolidone | 71.96 |

Example 9

| Component | Weight (%) |
|---|---|
| Polyimide | 20.0 |
| Carbon black | 4.0 |
| Vapor grown carbon nanofiber | 3.0 |
| Graphite | 1.0 |
| Zirconia particles | 2.0 |
| N-methyl pyrrolidone | 70.0 |

Example 10

| Component | Weight (%) |
|---|---|
| Polyimide | 20.0 |
| Carbon black | 5.0 |
| Zirconia particles | 3.0 |
| PTFE | 2.0 |
| N-methyl pyrrolidone | 70.0 |

Materials Sources

Polyamideimide can be obtained from Amoco Corp.
Polyimide can be obtained from Dupont Corp.
Phenolic can be obtained from Borden chemicals Corp.
Diallylyl isopthalate can be obtained from DAISO Corp.
Aromatic cyanate ester can be obtained from Lonza Corp.
Carbon Nanotubes can be obtained from Carbolex Corp.
Vapor grown carbon nano fibers can be obtained from Applied Sciences Corp.
Milled carbon fibers can be obtained from Zoltech Corp.
Graphite can be obtained from Degusaa Corp.
Carbon black can be obtained from Degusaa Corp.
Zirconia particles can be obtained from Zircoa Corp.
Wetting agent can be obtained from 3M Corp.

Cured Resistive Film

Figure 5:
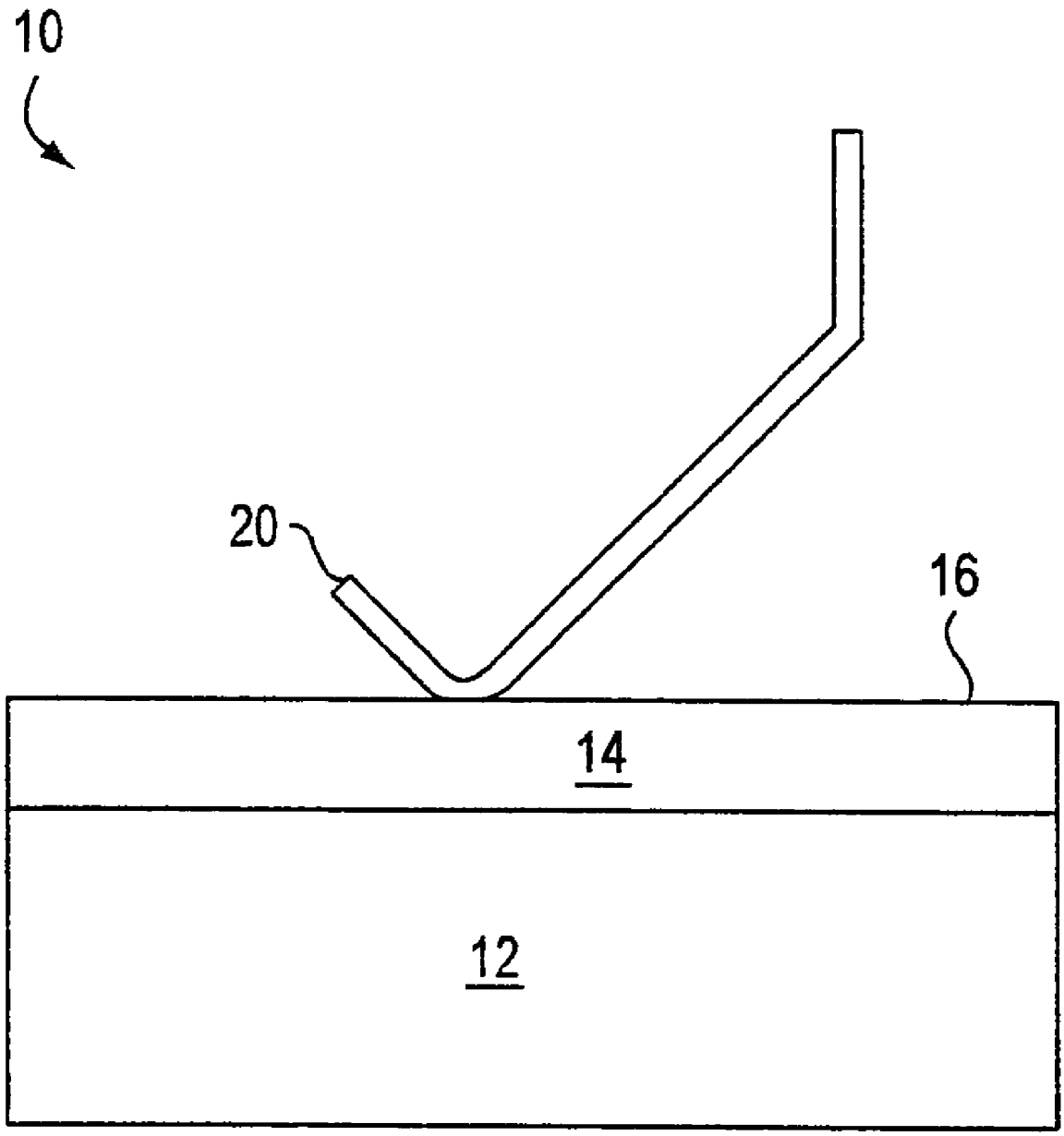
FIG. 5 shows a cured film of a resistor composition of the present invention along with a wiper forming a variable resistor.

After the resistive composition of the present invention has been applied to a substrate and cured, a resistive film results. The film can be used in a variable resistor or potentiometer. Referring to FIG. 5, a potentiometer 10 is shown. Potentiometer 10 has a substrate 12 with a resistive film 14. Resistive film 14 has an upper surface 16. Film 14 is typically 10 to 20 microns in thickness. A wiper 20 is in mechanical and electrical contact with film 14 on surface 16. Wiper 20 mechanically moves across surface 16. When a voltage is applied across the resistive film 14 and measured at the wiper 20, the voltage varies according to the position of the wiper on the film due to the resistance change. The resistive compositions of examples 1–10 that were previously described have the following material compositions after curing into a resistive film. All compositions are weight percent based on total composition.

TABLE 1

| Example | Polymer | Carbon black | Vapor grown carbon fibers | Milled carbon fibers | PTFE | Nano Clay | Carbon Nano-tubes | Graphite | Zirconia |
|---|---|---|---|---|---|---|---|---|---|
| Example 1 | 77.8 | 19.8 | | | | | | | 2.47 |
| Example 2 | 75.95 | 19.26 | | | | 2.39 | | | 2.39 |
| Example 3 | 74.18 | 18.81 | | 2.33 | | 2.33 | | | 2.33 |
| Example 4 | 75.95 | 19.26 | 2.39 | | | | | | 2.39 |
| Example 5 | 74.18 | 18.81 | 2.33 | 2.33 | | | | | 2.33 |
| Example 6 | 74.18 | 18.81 | 2.33 | | | 2.33 | | | 2.33 |
| Example 7 | 74.18 | 18.81 | | 2.33 | | | 2.33 | | 2.33 |
| Example 8 | 75.95 | 19.26 | | 2.39 | | | | | 2.39 |
| Example 9 | 66.66 | 13.33 | 10 | | | | | 3.33 | 6.66 |
| Example 10 | 66.66 | 16.66 | | | 6.66 | | | | 10 |

The cured resistive film has a composition of 40–80 weight % cured polymer resin, 10–35 weight % of conductive particles, 0.025–20 weight % of carbon nanoparticles, 0–20.0 weight % of PTFE, 0.1–20 weight % of nanoclay and 0.1–11.0 weight % zirconia particles.

The zirconia particles reduce wear between the wiper and the film as the wiper moves across the film.

Testing

The cured film resulting from the composition of the present invention was tested for electromechanical wear properties. A 13 finger palladium metal brush wiper was moved repeatedly back and forth across the film to simulate the motion as used in a potentiometer. After 1.7 million cycles of wiping at −40C to 135C temperature ranges, the test samples were measured for wear. The wear depth and area was measured by a Tencor P-10 surface profilometer for the prior art composition and the compositions of examples 1, 2 and 3. The test results are shown in FIGS. 1–4. FIGS. 1–4 show the surface profile or wear depth of the test samples across the width of the sample. The sample width in microns is shown on the x-axis and the film thickness in angstroms is shown on the y-axis.

Figure 2:
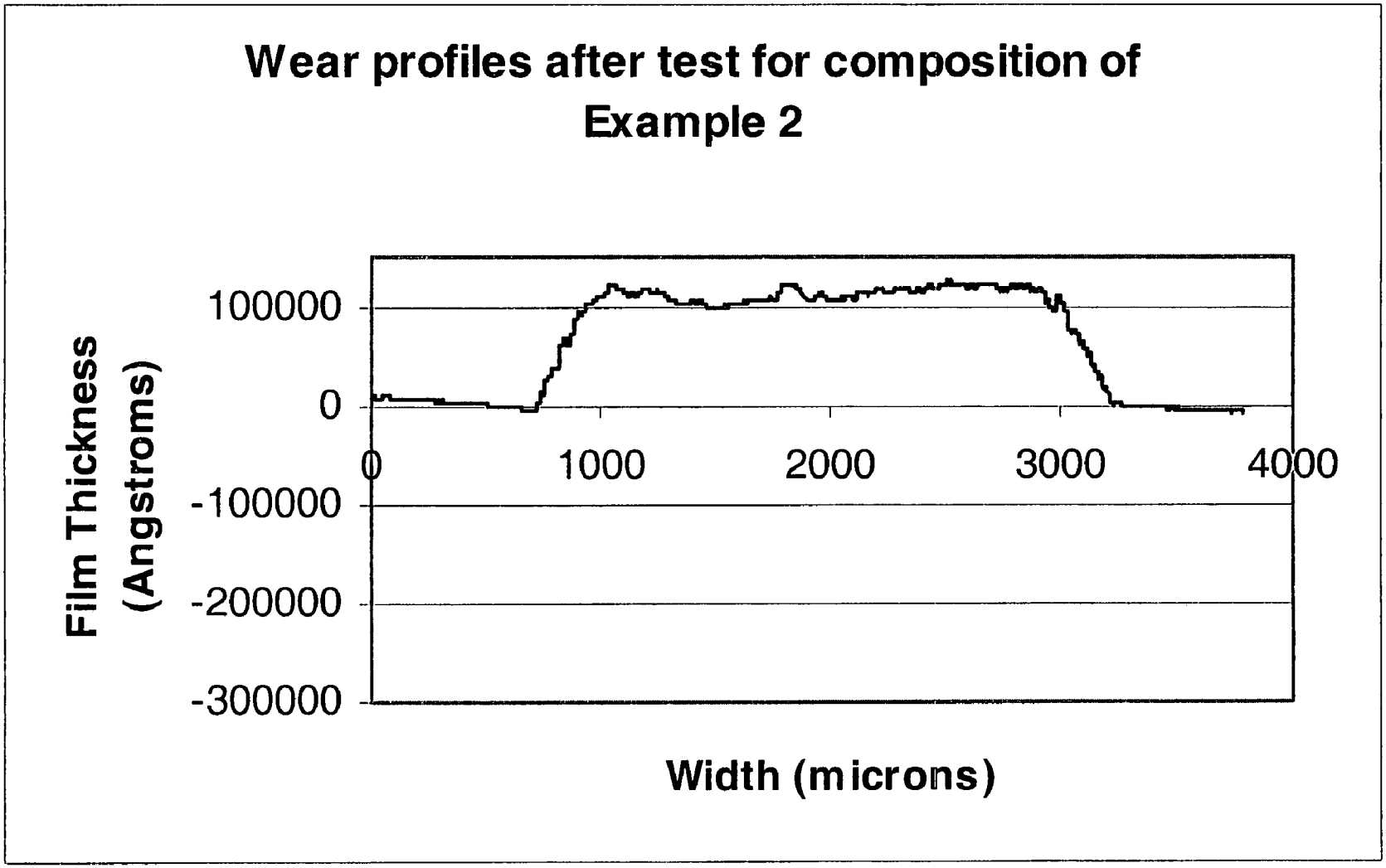
FIG. 2 shows the surface profile or wear for the resistor composition of example number 2 after durability testing.
Figure 3:
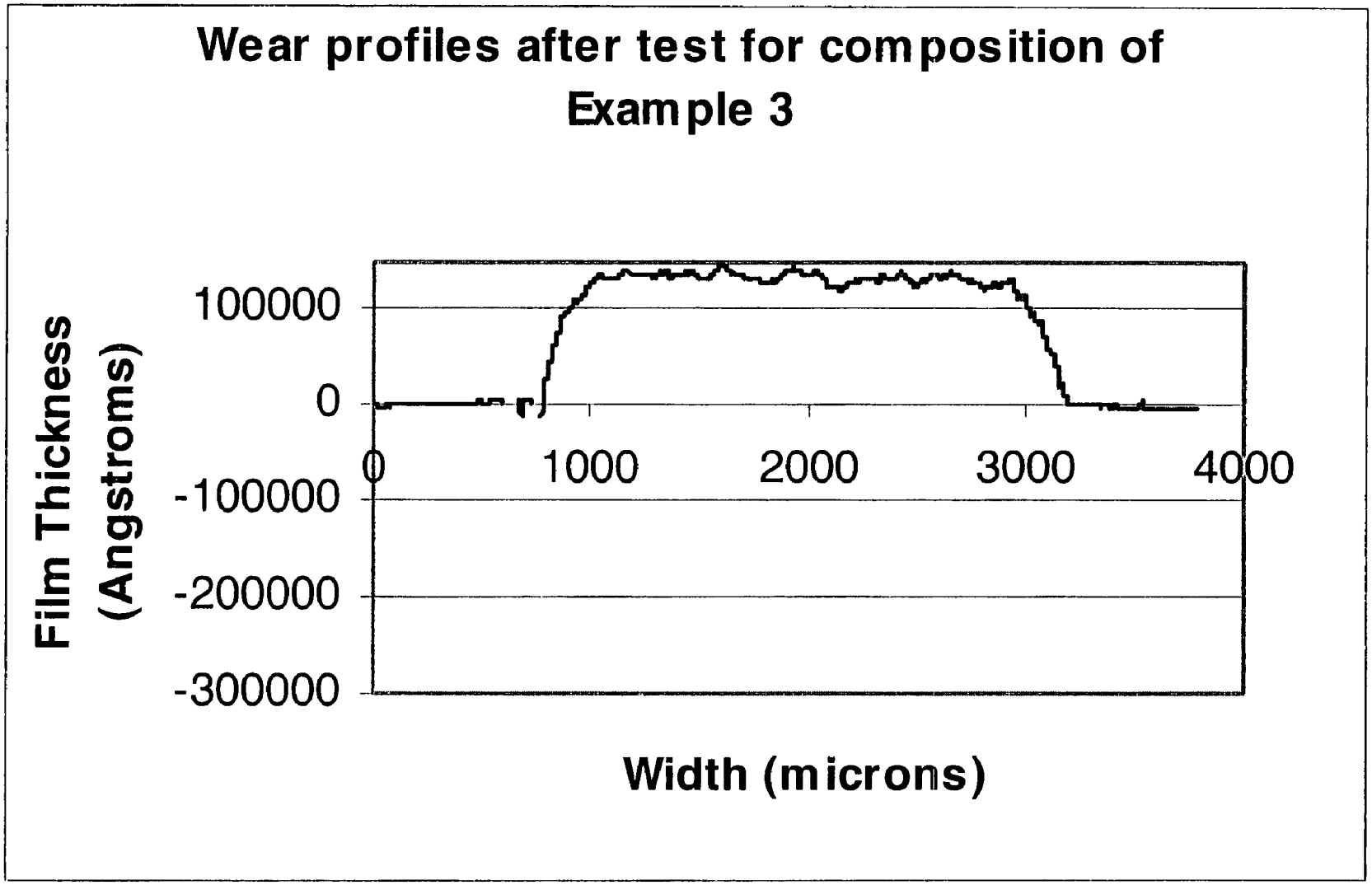
FIG. 3 shows the surface profile or wear for the resistor composition of example number 3 after durability testing.
Figure 4:
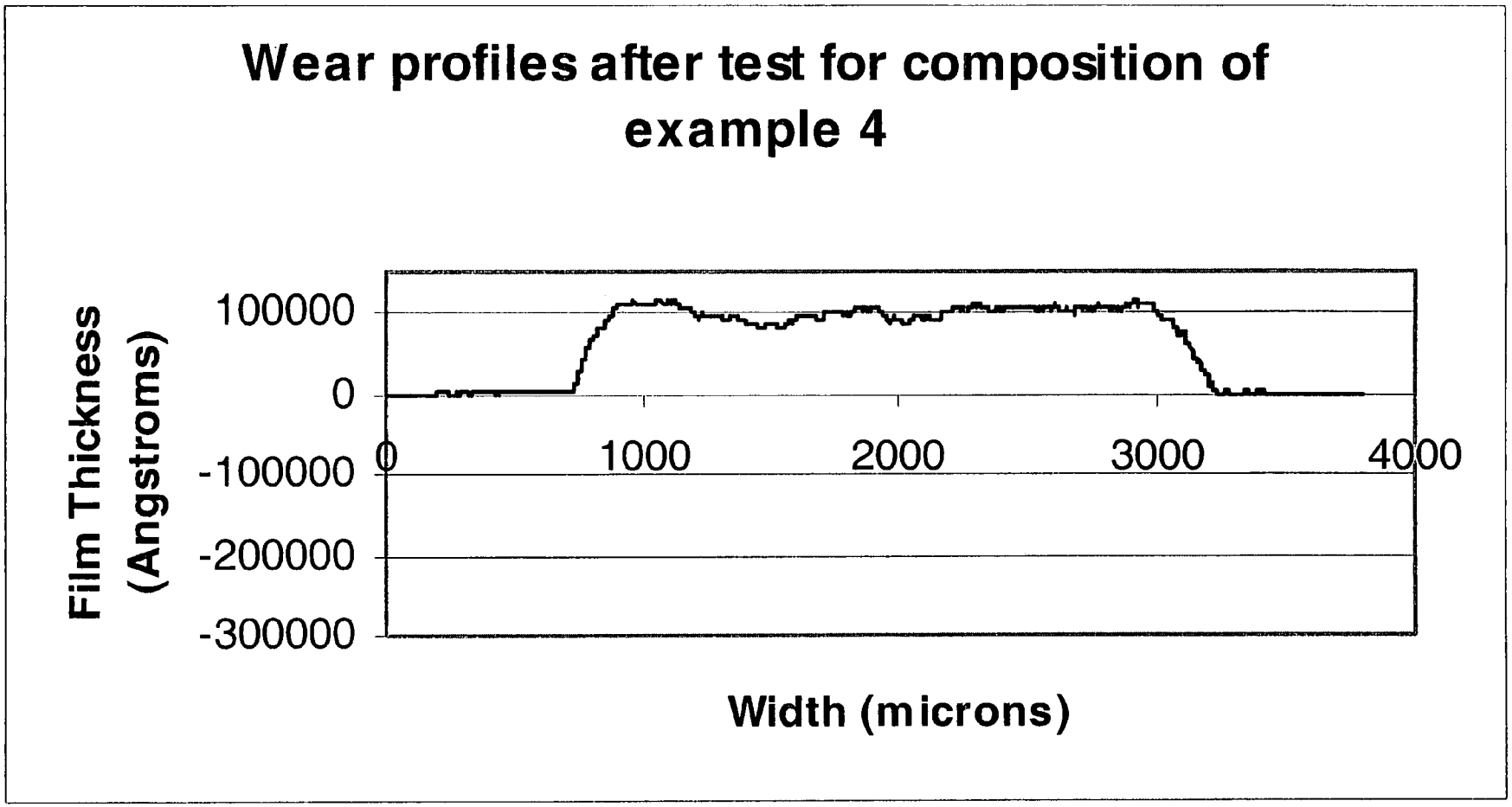
FIG. 4 shows the surface profile or wear for the resistor composition of example number 4 after durability testing.

It is noted that the wear properties of the films prepared using the composition of the present invention as shown in FIGS. 2–4 are greatly improved over the prior art composition of FIG. 1. In FIG. 1, the fingers of the contactor have made worn through and created wear grooves in the surface of the resistive film. In contrast, the resistive compositions of the present invention experienced almost no wear.

Discussion

One advantage of the present invention is that by incorporating zirconia particles into a resistive composition, the resulting cured film has improved mechanical wear properties. The presence of Zirconia particles in the cured films imparts high micro-hardness to these cured films. These micro-hardness properties are very important for sliding contact applications. Zirconia has high strength and very high toughness. The ratio of fracture toughness to hardness has been shown to be of significance in the wear behavior of materials. The high value for this ratio with Zirconia ceramics leads to their excellent wear resistance in applications. In addition Zirconia is inert and has a low coefficient of friction. In addition to high fracture toughness, stabilized Zirconia absorbs energy of impact that shatters other ceramics and can tolerate thermal gradients better than most other high temperature materials.

The invention provides a decrease in contactor wear by either avoiding the use of relatively large carbon fibers or by using a very small concentration of very finely milled carbon fibers in conjunction with zirconia particles. Due to the large surface to volume ratio, nanoparticles and nanofibers need to be used in less than 5 volume percentage. This significantly reduces the tendency of the contactor to prematurely wear.

The invention creates a resistor surface with a homogeneous electrical and mechanical surface in nanoscale. During a high frequency small stroke dither test, the contactor will always be sliding on a mechanically tough zirconia nanocomposite surface. In contrast, the high frequency small stroke dither test on a composition of the prior art can gouge and pit a resistor surface where zirconia particles are absent.

The invention decreases the coefficient of thermal expansion (CTE) of the resistor material. Wear of resistor materials typically is significantly increased at high temperature. One of the reasons for this phenomenon is the increased expansion of the material. By incorporating molecular silica, nanoclay, and nanofibers, molecular scale interactions with the polymer matrix are achieved. These strong interactions in nanoscale decrease the CTE of the material. In contrast, significantly large amount of fibers would be needed to be added to a polymer matrix to decrease the matrix's thermal expansion coefficient. As mentioned earlier, adding a large amount of carbon fibers to the matrix can significantly wear the associated metallic contactor.

The invention uses high glass transition temperature polymers, which form secondary bonding with the nanomaterials. The polymer matrix resin is selected from any high performance thermoplastic or thermosetting resins. The functional groups in the polymers should have good interactions with the nanoparticles. For instance, polyimide, polyamideimide, phenolic, DAIP, Epoxy, Bismaleimide, etc can be used in acccordance with the invention.

While the invention has been taught with specific reference to these embodiments, someone skilled in the art will recognize that changes can be made in form and detail without departing from the spirit and the scope of the invention. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A resistive composition, based on total composition, comprising:

a) 5–30 wt. % of polymer resin;

b) 10–30 wt. % conductive particles selected from the group consisting of carbon black, graphite, silver, copper, nickel and mixtures thereof;

c) 0.01–10 wt % zirconia particles; and e) a 60–80 wt. % organic solvent, wherein the polymer resin, conductive particles, and zirconia particles are dispersed in the organic solvent.

2. The resistive composition of claim 1 further comprising: 0.025–20 wt. % nanoparticles.

3. The resistive composition of claim 2 wherein the nanoparticles are chosen from the group consisting of nanotubes, nanofibers and mixtures thereof.

4. The resistive composition of claim 2 wherein the nanoparticles include 0.1–5 wt. % of molecular silica.

5. The resistive composition according to claim 4, wherein the molecular silica has a particle size less than 100 nanometers.

6. The resistive composition of claim 2 wherein the nanoparticles include 0.1–5 wt. % of nanoclay.

7. The resistive composition according to claim 6, wherein the nanoclay has a particle size less than 100 nanometers in one dimension.

8. The resistive composition of claim 2 wherein the nanoparticles are carbon nanotubes which constitute 1–7 wt. % of the resistive composition.

9. The resistive composition according to claim 8, wherein the carbon nanotubes have a particle size less than 100 nanometers in one dimension.

10. The resistive composition according to claim 8, wherein the carbon nanotubes are vapor grown and have a particle size range of 50 nanometers to 10 microns in one dimension.

11. The resistive composition according to claim 2, wherein the carbon nanoparticles are milled carbon fibers that have a particle size range of 100 nanometers to 10 microns in one dimension.

12. The resistive composition of claim 2 wherein the nanoparticles are selected from the group consisting of vapor grown carbon nanofibers, milled carbon fibers and mixtures thereof.

13. The resistive composition of claim 1 wherein the nanoparticles comprise 0.1–7 wt. % of the resistive composition.

14. The resistive composition of claim 1 further comprising: 1–20 wt. % fluropolymer.

15. The resistive composition of claim 1 wherein the polymer resin is chosen from the group consisting of polyimides, polyamide imides, polysulfones, polyphenylenes, polyether sulfones, polyarylene ethers, polyphenylene sulfides, polyarylene ether ketones, phenoxy resins, polyether imides, polyquinoxalines, polyquinolines, polybenzimidazoles, polybenzoxazoles, polybenzothiazoles, phenolic, epoxy and diallyll isophthalate.

16. The resistive composition of claim 1 further comprising greater than 0 up to and including 10 wt. % of a thermosetting resin.

17. The resistive composition of claim 16 wherein the thermosetting resin is selected from the group consisting of aromatic cyanate ester, epoxy, phenolic, diallyl isophthalate and bismaleimide.

18. The resistive composition according to claim 1, wherein the zirconia particles have a particle size less than 0.5 micron.

19. The resistive composition according to claim 1, wherein the resistive composition is applied to a substrate, the substrate being selected from the group consisting of polyimide, ceramic, FR-4, and fiber reinforced phenolic substrates.

20. The resistive composition according to claim 1, wherein the organic solvent is selected from the group consisting of: N-methyl pyrrolidone, diallyl pthalate, glycol ether and dimethyl formamide.

21. The resistive composition according to claim 1 wherein the polymer resin comprises 15–20 wt. % of the resistive composition.

22. The resistive composition of claim 1 wherein the conductive particles comprise 15–20 wt. % of the resistive composition.

23. The resistive composition of claim 1 wherein the zirconia particles comprise 0.01–3.0 wt. % of the resistive composition.

24. A method of forming a variable resistive element comprising:

a) preparing a resistive composition by:

forming a polymer solution by mixing at least a polymer resin and an organic solvent;

mixing the polymer solution with conductive particles and zirconia particles to form a paste, wherein the zirconia particles are less than 0.5 microns in size;

b) applying the resistive composition to a substrate; and c) curing the resistive composition on the substrate.

25. The method of claim 24, further comprising:

adding at least one of surfactants and rheological additives to the polymer solution in preparing the resistive composition.

26. The method of claim 24, further comprising:

adding nanoparticles to the polymer solution in preparing the resistive composition.

27. The method of claim 24, further comprising:

applying the resistive composition to a film thickness of approximately 40 microns on the substrate.

28. The method of claim 24, further comprising:

mixing the polymer solution with the conductive and zirconia particles through ball milling.

29. The method of claim 24, further comprising:

monitoring a viscosity of the paste; and controlling the mixing based on the viscosity.

30. An applied film comprising:

a) 40–80 percent by weight of a cured polymer resin;

b) 10–35 percent by weight of conductive particles selected from the group consisting of carbon black, graphite and mixtures thereof; and c) 0.01–11 wt. percent by weight of zirconia particles, wherein the zirconia particles are less than 0.5 microns is size.

31. The film according to claim 30 further comprising: 0.025–20 wt. percent nanoparticles.

32. The film according to claim 30 wherein the film is applied to a substrate.

33. The film according to claim 32 wherein the film is adapted to be contacted by a wiper thereby forming a variable resistor.

34. The film according to claim 30 further comprising: 2.0–4.0 wt. percent zirconia.

* * * * *